United States Patent [19]

Kile

[11] Patent Number: 5,032,214

[45] Date of Patent: Jul. 16, 1991

[54] LINEAR BEAM SPLICER

[75] Inventor: Anthony W. Kile, Dalton, Ga.

[73] Assignee: Williams Specialty Co., Dalton, Ga.

[21] Appl. No.: 431,077

[22] Filed: Nov. 3, 1989

[51] Int. Cl.[5] ..... B65H 69/06

[52] U.S. Cl. ..... 156/502; 156/158; 242/35.6 R; 242/58.1; 242/58.4

[58] Field of Search ..... 156/158, 502, 504; 242/35.6 R, 58.1, 58.4

[56] References Cited

U.S. PATENT DOCUMENTS

| | | | |
|---|---|---|---|
| 3,055,786 | 9/1962 | Hendrix | 156/158 |
| 3,438,834 | 4/1969 | Johnston | 156/515 |
| 3,616,054 | 10/1971 | Williams | 156/158 |
| 3,695,975 | 10/1972 | Williams | 156/158 |

*Primary Examiner*—Michael W. Ball
*Assistant Examiner*—Francis J. Lorin
*Attorney, Agent, or Firm*—Brady, O'Boyle & Gates

[57] ABSTRACT

A linear beam splicer including a splicing unit mounted on a frame and positioned between a beam support rack and a tufting machine. The splicing unit includes a frame carrying a grip and gauging bar assembly for holding the yarns to be spliced, and a longitudinally extending heating element mounted on the frame and extending parallel to and below the grip and gauging bar assembly. The heating unit is pivotally connected at each end thereof to the frame by an oscillating crank mechanism, whereby the heating element is moved in a linear direction against the yarns to be spliced, whereby all the yarns are spliced simultaneously.

4 Claims, 4 Drawing Sheets

FIG. 2
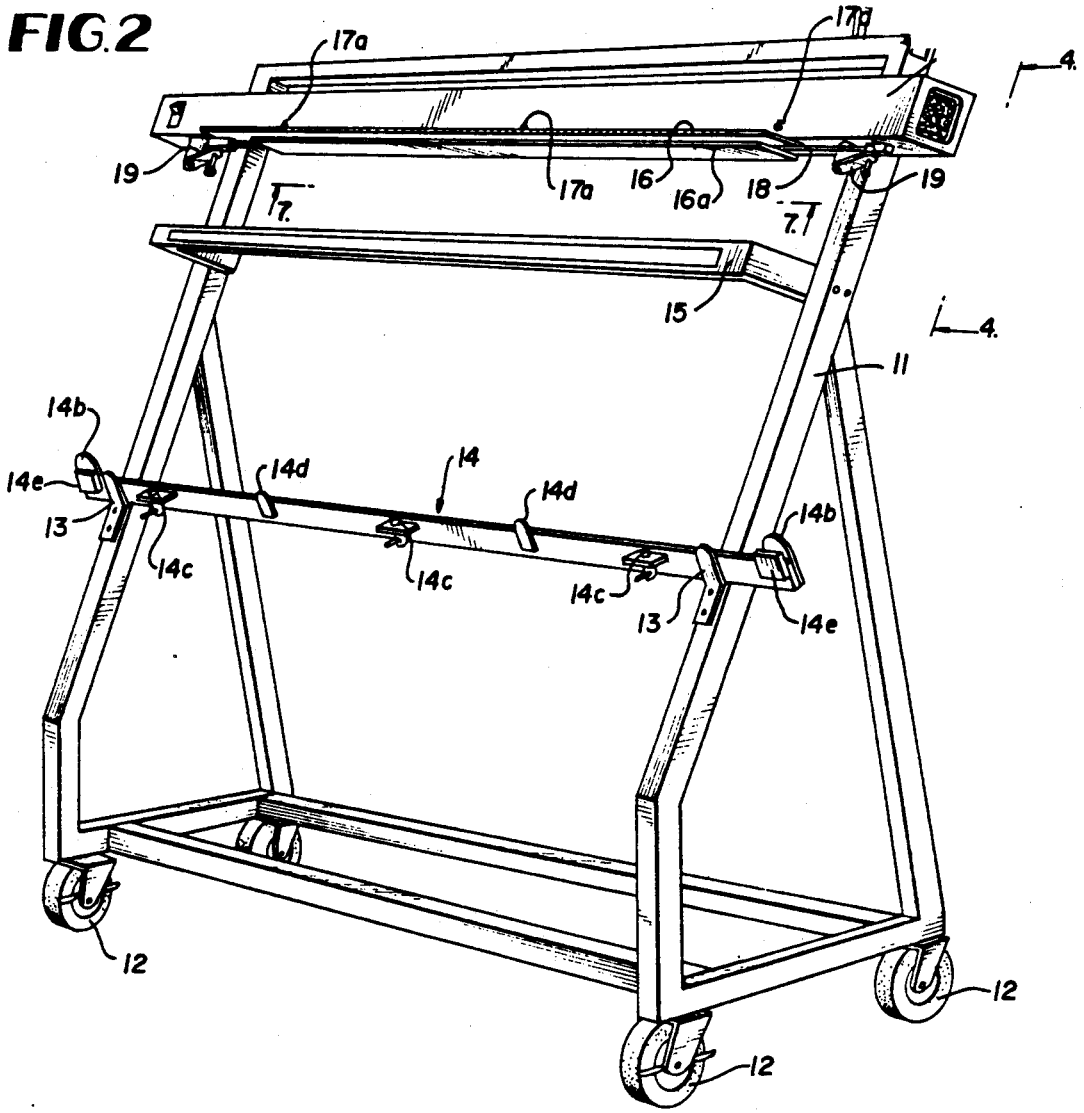
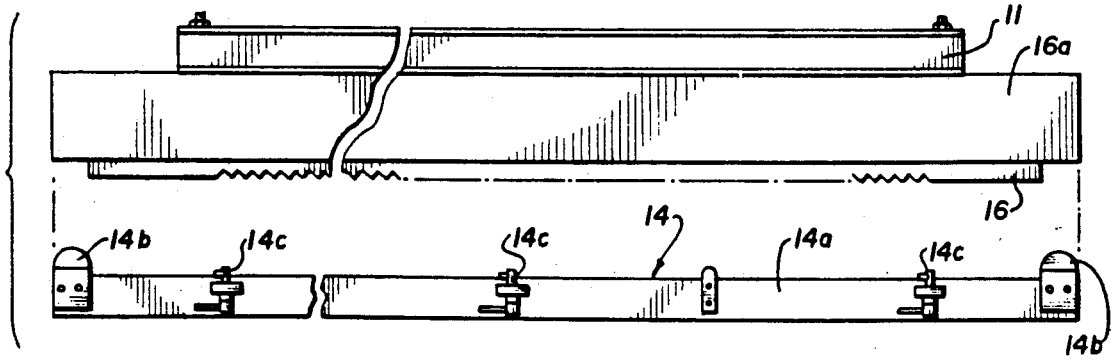
FIG. 3

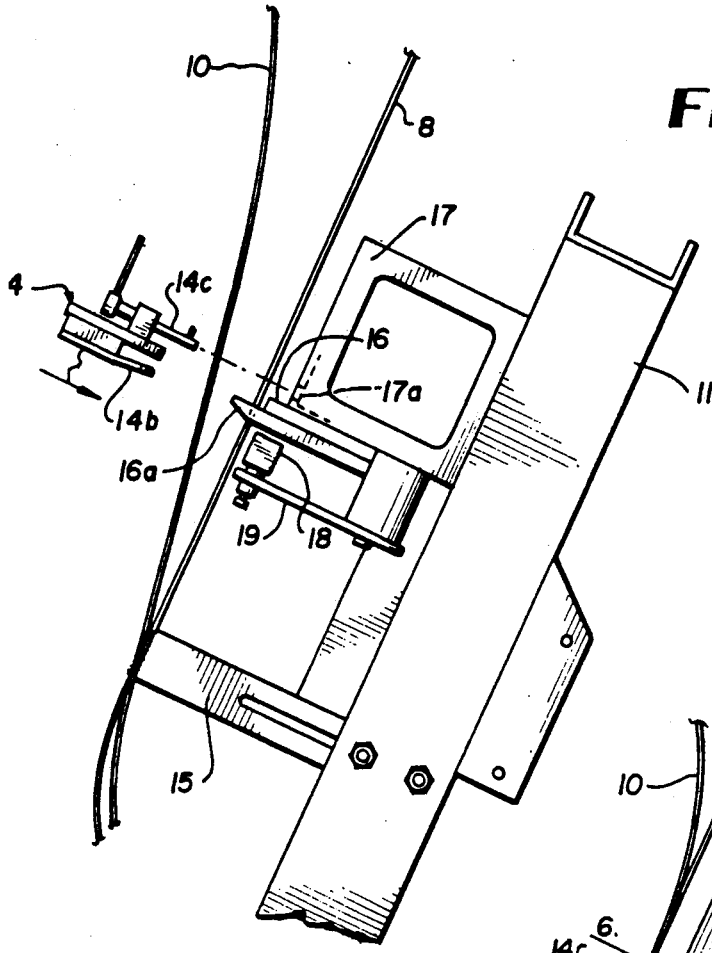
FIG.4
FIG.5
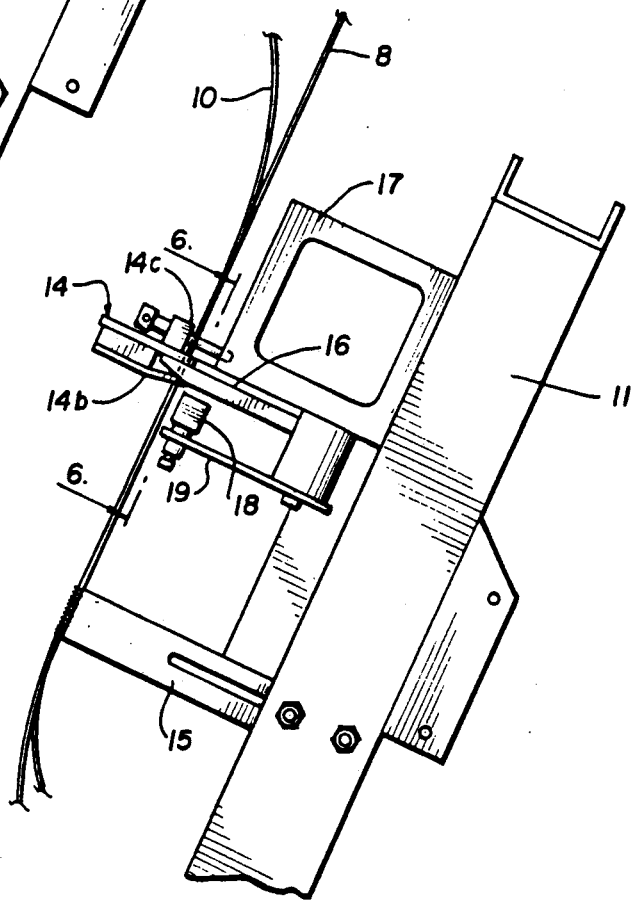
FIG.6
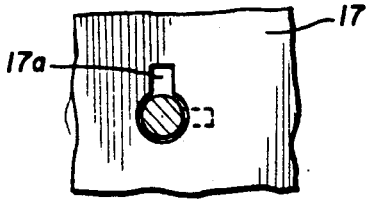

LINEAR BEAM SPLICER

BACKGROUND OF THE INVENTION

In the tufting of modern carpet, a plurality of beams of thermoplastic yarn, wherein each beam may contain as many as one hundred and fifty individual yarn ends, are fed continuously to a tufting machine. The beams of yarn are customarily mounted on racks in proximity to the tufting machine. As the individual beams become exhausted, they must be replaced rapidly with full beams, and when this is done, the ends of the yarn on the full beam must be spliced with a corresponding number of yarn ends trailing from the tufting machine.

In U.S. Pat. No. 3,695,975, an apparatus is disclose for splicing a multitude of thermoplastic yarn ends, wherein a movable heat splicing unit is provided for movement in a transverse direction across the individual yarns to be spliced, whereby successive splices are made between the ends of the yarn on the full beam with a respective yarn end trailing from the tufting machine.

While the splicing apparatus disclosed in the abovementioned patent is satisfactory for producing splices which are strong and cause no objectionable enlargements to interfere with the tufting machine needle eyes, the time of travel for the transverse movement of the heat splicing unit across the successive yarns to be spliced delayed the splicing process.

In order to expedite the splicing process, the linear beam splicer of the present invention has been devised whereby the plurality of the ends of the yarn on the full beam and the respective yarn ends trailing from the tufting machine are simultaneously spliced together, rather than successively spliced as disclosed in the aforementioned patent.

The linear beam splicer of the present invention comprises, essentially, a splicing unit mounted on a frame and positioned between a beam support rack and a tufting machine. The splicing unit includes a frame carrying a grip and gauging bar assembly adapted to hold the yarns to be spliced, and a longitudinally extending heating element mounted on the frame and extending parallel to and below the grip and gauging bar assembly. The heating unit is pivotally connected at each end thereof to the frame by an oscillating crank mechanism, whereby the heating element is moved in a linear direction against the yarns to be spliced, whereby all the yarns are spliced simultaneously.

BRIEF DESCRIPTION OF THE DRAWINGS

FIG. 2 is a perspective view of the linear beam splicer of the present invention;

FIG. 3 is a composite elevational view of a grip and gauging bar assembly employed in the linear beam splicer of the present invention;

FIG. 4 is an enlarged, fragmentary side elevational view of the linear beam splicer showing the grip and gauging bar assembly being operatively connected to the splicing unit for holding the yarns to be spliced;

FIG. 5 is an enlarged, fragmentary side elevational view of the linear beam splicer showing the grip and gauging bar operatively connected to the splicing unit and holding the yarns to be spliced:

FIG. 6 is a fragmentary view taken along line 6—6 of FIG. 5;

DESCRIPTION OF THE PREFERRED EMBODIMENT

Figure 1:
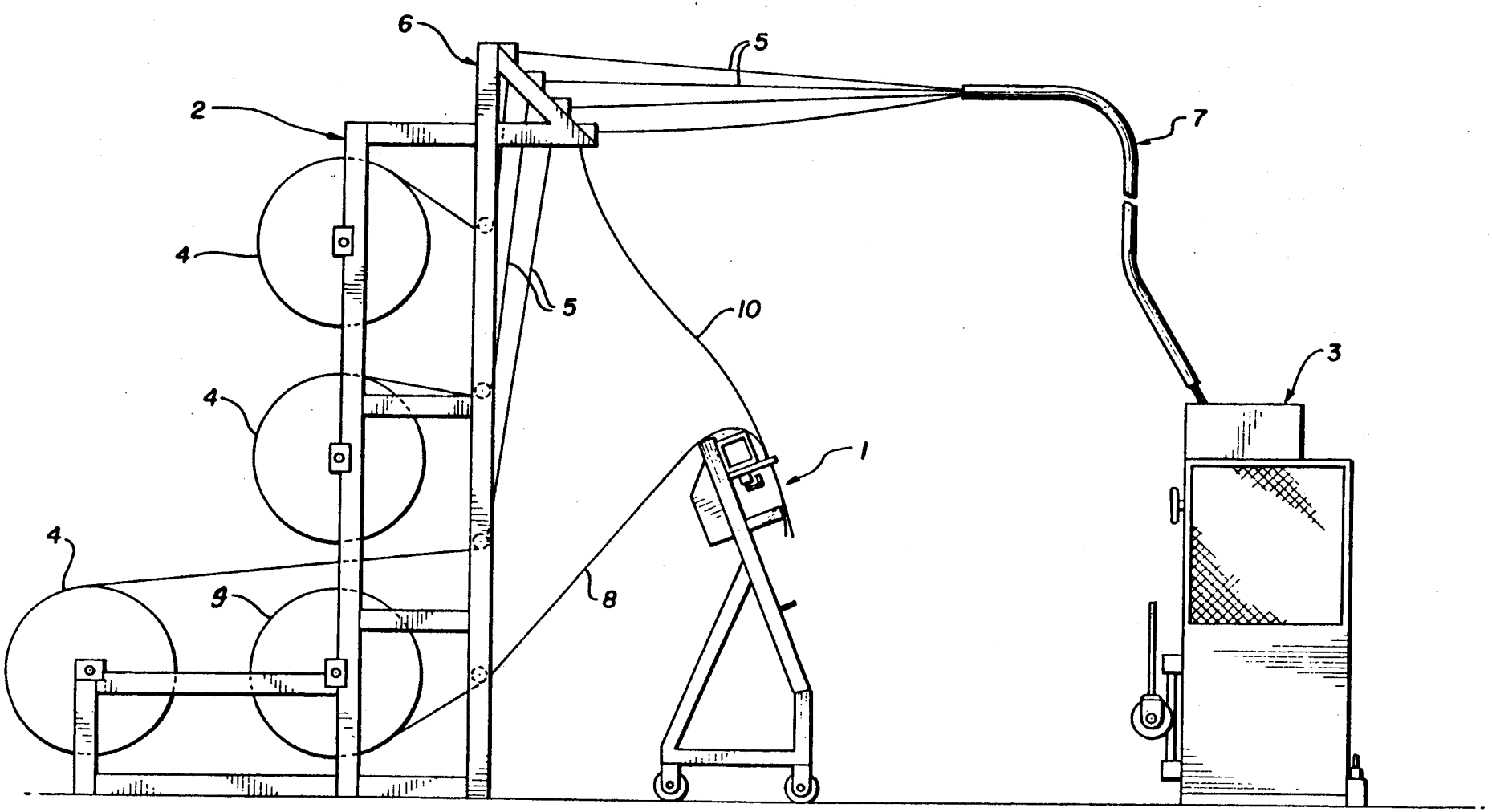
FIG. 1 is a diagrammatic side elevational view of the linear beam splicer of the present invention positioned between a beam support rack and a tufting machine.

Referring to the drawings and more particularly to FIG. 1, the linear beam splicer 1 of the present invention is positioned between a conventional beam support rack 2 and a conventional tufting machine 3. A plurality of yarn beams 4 are rotatably mounted on the rack 2 and the yarns 5 therefrom are continuously fed through the beam rack header 6 to yarn collector tubes 7, and into the tufting machine 3.

The linear beam splicer 1 of the present invention is adapted to splice a new yarn end 8 from a replenished yarn beam 9 to the end of a yarn end 10 trailing into the tufting machine 3.

The details of construction of the linear beam splicer 1 are illustrated in FIG. 2 wherein a frame 11 mounted on caster wheels 12 has a hanger 13 for supporting a removably mounted gripping bar 14. A transversely extending sticker or yarn holding bar 15 is fixedly mounted on the frame 11 and a gauge bar 16 is fixedly mounted to the bottom wall of a housing 17. A transversely extending heating element 18 extends below the gauge bar 16 and parallel thereto, and is pivotally connected to the housing 17 at each end thereof by oscillating crank mechanisms 19 which impart a linear motion to the heating element 18, to be described more fully hereinafter.

Referring to FIG. 3, the gripping bar 14 comprises an elongated metallic strip **14*a* having fingers 14*b* extending from one edge thereof on each end of the strip 14*a*. A plurality of locking pins 14*c* are mounted on the face of the strip 14*a*. As will be seen in FIG. 2, the opposite face of the strip 14*a* has a pair of fingers 14*d* extending outwardly from the edge thereof, and also a pair of plates 14*e* on the end of the strip opposite the fingers 14*b*, to thereby provide a space therebetween for receiving the end portion of a fixed plate 16*a* mounted on the frame below the gauge bar 16. The fingers 14*d* are adapted to engage the face of the fixed plate 16*a*** intermediate the ends thereof.

To hold the yarns to be spliced, the gripping bar assembly 14 is manually moved from the frame hangers 13, and moved to a position shown in FIG. 4, wherein the locking pins **14*c* are aligned with cooperating apertures 17*a* (FIG. 6) provided in the front wall of the housing 17. The yarns 8 and 10 to be spliced are initially held in alignment by the yarn holding bar 15**.

Figure 7:
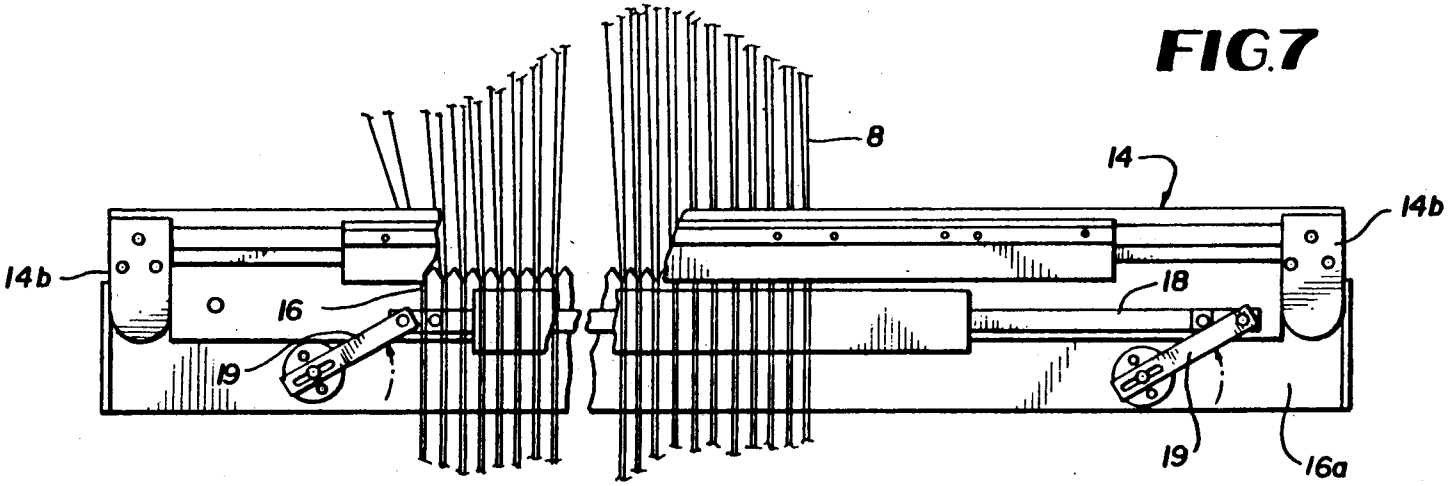
FIG. 7 is a fragmentary front elevational view of the splicer showing the gripped yarns to be spliced prior to actuation of the heating element.

The gripping bar assembly 14 is then connected to the housing by inserting the locking pins **14*c* into the apertures 17*a* and rotating the pins to the locked position as shown in dotted lines in FIG. 6, whereby the yarns to be spliced are gripped between the gripping bar 14 and the gauge bar 16, as shown in FIGS. 5 and 7**.

Figure 8:
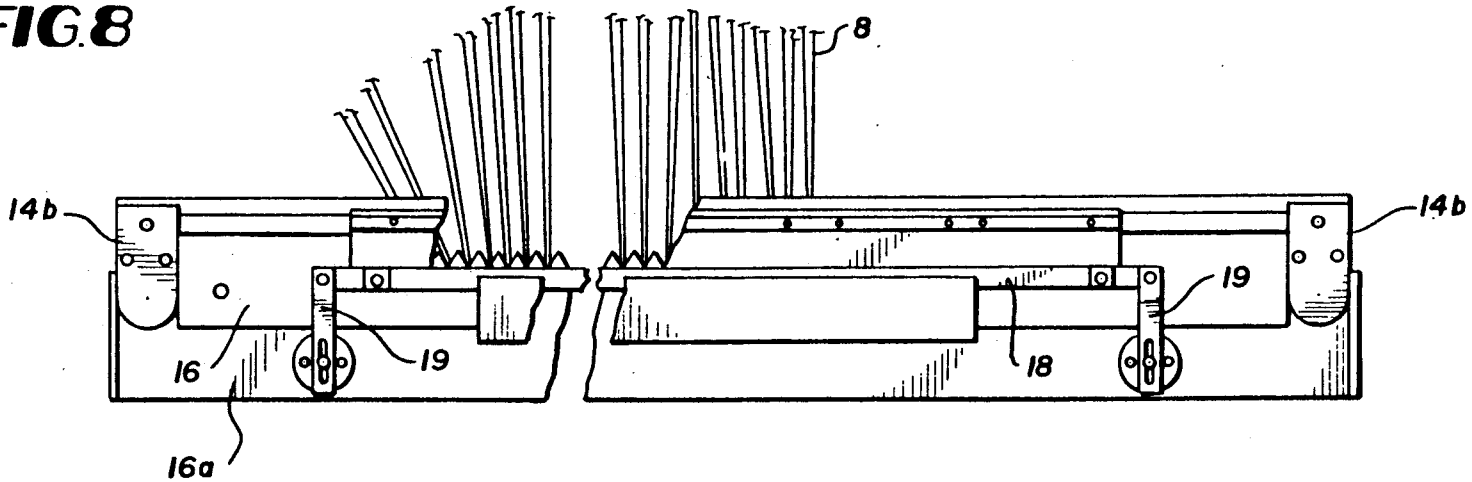
FIG. 8 is a fragmentary front elevational view of the splicer showing the yarns spliced after the heating element has been actuated.

The crank mechanisms are then actuated to move the heating element 18 in a linear direction toward the gripped portions of the yarn, as shown in FIG. 8, whereupon the yarn becomes heated and fused to form a splice.

It will be understood by those skilled in the art that the electrical components and mechanical mechanisms for energizing the heating element 18 and for actuating the crank mechanisms 19 will be contained in the housing 17 which, as shown in FIG. 1, will have a switch 20 on one end thereof and a vent cover 21 on the opposite end thereof.

From the above description, it will be appreciated by those skilled in the art that the beam splicer of the present invention provides an improved apparatus for simultaneously splicing a plurality of thermostatic yarns together which, heretofore, have been spliced individually or sequentially.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A linear beam splicer for splicing a plurality of thermoplastic yarn ends from a full yarn beam mounted on a beam support rack to respective yarn ends trailing from a tufting machine, comprising, a frame, a gauge bar mounted on said frame for receiving the yarn ends to be spliced, a gripping bar operatively connected to said gauge bar for holding said yarn ends, a housing connected to said frame, said housing including a front wall and a bottom wall positioned above the gauge bar and extending along the length of said gauge bar, a heating element extending along the length of said gauge bar and said gripping bar, an oscillating crank mechanism connected between the bottom wall of the housing and to each end of said heating element, electrical components for energizing the heating element contained within the housing, mechanical mechanisms for actuating the crank mechanism contained within said housing, whereby the heating element is movable in a direction from underneath the bottom wall of the housing to an exposed position against the plurality of gripped yarns, to thereby simultaneously splice the plurality of yarn ends together.

2. A linear beam splicer according to claim 1, wherein the front wall of said housing has lock pin receiving apertures, and lock pin means mounted on said gripping bar adapted to be inserted into said apertures, whereby the gripping bar is operatively connected to the gauge bar.

3. A linear beam splicer according to claim 1, wherein hanger means are provided on said frame for supporting the gripping bar when not operatively connected to said gauge bar.

4. A linear beam splicer according to claim 1, wherein the frame is mounted on wheels whereby the frame may be readily positioned between the beam support rack and the tufting machine.

* * * * *